US007893619B2

(12) United States Patent
Aurongzeb

(10) Patent No.: US 7,893,619 B2
(45) Date of Patent: Feb. 22, 2011

(54) HIGH INTENSITY DISCHARGE LAMP

(75) Inventor: Deeder Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 271 days.

(21) Appl. No.: 12/179,877

(22) Filed: Jul. 25, 2008

(65) Prior Publication Data

US 2010/0019675 A1 Jan. 28, 2010

(51) Int. Cl.
*H01J 17/20* (2006.01)

(52) U.S. Cl. ..... 313/641; 445/26

(58) Field of Classification Search ..... 313/623, 313/627–643, 567, 111–117, 25–27, 318.01–318.09; 439/615, 739; 445/24, 26, 29, 22
See application file for complete search history.

(56) References Cited

U.S. PATENT DOCUMENTS

| | | | | |
|---|---|---|---|---|
| 3,798,487 | A * | 3/1974 | Zollweg | 313/571 |
| 3,842,307 | A * | 10/1974 | Dobrusskin et al. | 313/620 |
| 4,647,814 | A | 3/1987 | Dobrusskin et al. | |
| 4,810,932 | A | 3/1989 | Ahlgren et al. | |
| 5,138,227 | A | 8/1992 | Heider et al. | |
| 5,220,244 | A | 6/1993 | Maseki et al. | |
| 5,239,232 | A * | 8/1993 | Heider et al. | 313/639 |
| 5,334,906 | A | 8/1994 | Muzeroll | |
| 5,451,838 | A * | 9/1995 | Kawai | 313/638 |
| 5,486,737 | A | 1/1996 | Hrubowchak et al. | |
| 5,614,787 | A * | 3/1997 | Kawai et al. | 313/623 |
| 5,929,563 | A | 7/1999 | Genz | |
| 5,965,984 | A | 10/1999 | Horiuchi et al. | |
| 6,107,742 | A * | 8/2000 | Seki et al. | 313/639 |
| 7,211,956 | B2 | 5/2007 | Tukamoto et al. | |
| 2007/0085482 | A1 | 4/2007 | Lambrechts et al. | |
| 2007/0138931 | A1 | 6/2007 | Ramaiah | |
| 2008/0111489 | A1 | 5/2008 | Johnston et al. | |

FOREIGN PATENT DOCUMENTS

| | | |
|---|---|---|
| EP | 1 763 065 B2 | 3/2007 |
| EP | 0 978 864 B1 | 12/2007 |

* cited by examiner

*Primary Examiner*—Nimeshkumar D Patel
*Assistant Examiner*—Donald L Raleigh
(74) *Attorney, Agent, or Firm*—Fay Sharpe LLP

(57) ABSTRACT

A lamp includes a discharge sustaining fill which includes mercury halide, cesium halide, optionally one of indium halide and thallium halide, and a rare earth halide component selected from dysprosium halide, holmium halide, and thulium halide. In operation without a jacket, the lamp may have a color temperature of about 5300K to 6000K, a color rendering index of at least about 92 and an efficacy of at least about 85 LPW.

23 Claims, 5 Drawing Sheets

HIGH INTENSITY DISCHARGE LAMP

BACKGROUND OF THE DISCLOSURE

The present disclosure relates to a high intensity discharge lamp (HID). More particularly, it relates to a metal halide lamp having high efficiency, good color rendering and high color temperature.

Metal halide lamps typically have a quartz, polycrystalline alumina (PCA), or a single crystal alumina (sapphire) arc discharge vessel filled with a mixture of gases, which may be surrounded by a protective envelope. The fill includes light emitting elements such as sodium and rare earth elements, such as scandium, indium, dysprosium, neodymium, praseodymium, and cerium in the form of a halide, with mercury, and generally an inert gas, such as krypton, argon or xenon. Metal halide lamps are disclosed, for example, in U.S. Pat. Nos. 4,647,814; 5,929,563; 5,965,984; and 5,220,244. While lamps of this type having an outer jacket or envelope have been formed with relatively high color temperatures, unjacketed arc tubes (in which the discharge chamber is in direct contact with the atmosphere, generally have a much lower color temperature or poor color rendition index (CRI). U.S. Pat. Nos. 5,138,227 and 5,486,737 disclose double ended lamps which operate at high wattage.

The entertainment industry desires bright, white light compact sources that enable efficient collection and focusing of the light to produce multiple effects such as the projection of Gobos, color patterns, and moving lights. However, at high wall loadings, color temperatures are generally low.

There remains a need for a lamp which can operate at high power and provide both high color temperatures and good color rendering for such applications.

SUMMARY OF THE DISCLOSURE

In one aspect of the disclosure a lamp includes a discharge vessel. Electrodes extend into the discharge vessel. A discharge vessel sustaining the fill is sealed within the discharge vessel. The fill includes an inert gas, and a halide component including mercury halide cesium halide, optionally at least one of neodymium halide and thallium halides, and a rare earth halide component including dysprosium halide, holmium halide, and thulium halide.

In another aspect of the disclosure, a method of forming a lamp, includes providing a discharge vessel and sealing an ionizable fill within the vessel. The fill includes an inert gas, a halide component including a mercury halide, a cesium halide, optionally, a thallium halide, and a thallium halide. The fill further includes rare earth halides including dysprosium halide, holmium halide, and thulium halide electrodes are positioned within the discharge vessel which energize the fill when an electric current is applied thereto.

In another aspect, a high intensity discharge lamp which operates at over 1,000 watts, includes a discharge vessel, electrodes extending into the discharge vessel; and an ionizable fill sealed with the vessel. The fill consists essentially of an inert gas, and a halide component, the halide component consisting essentially of 25-70 mol % of mercury halide, 5-15 mol % of cesium halide, a total of 0-22 mol % of at least one of neodymium halide, indium halide, and thallium halide, and a total of 20-60 mol % of a dysprosium halide, a holmium halide, and a thulium halide.

One advantage of at least one embodiment of the present disclosure is the provision of a lamp filled with improved performance and luminous efficiency.

Another advantage of at least one embodiment of the present disclosure resides in high color temperature.

Another advantage of at least one embodiment of the present disclosure resides in high color rendering index.

Still further advantages of the present disclosure will become apparent to those of ordinary skill in the art upon reading and understanding the following detailed description of the preferred embodiments.

DETAILED DESCRIPTION OF THE PREFERRED EMBODIMENTS

Aspects of the exemplary embodiment relate to double-ended high intensity discharge (HID) lamp including a discharge vessel which contains a discharge sustaining fill including a noble gas, such as xenon or argon, a mercury halide component (Y), and a metal halide (X) component. The metal halide component includes a cesium halide, optionally at least one of neodymium and thallium halides, and a rare earth halide selected from the group consisting of dysprosium, holmium, and thulium. In general, at least one of dysprosium, holmium and thulium halide is present in the fill.

Figure 1:
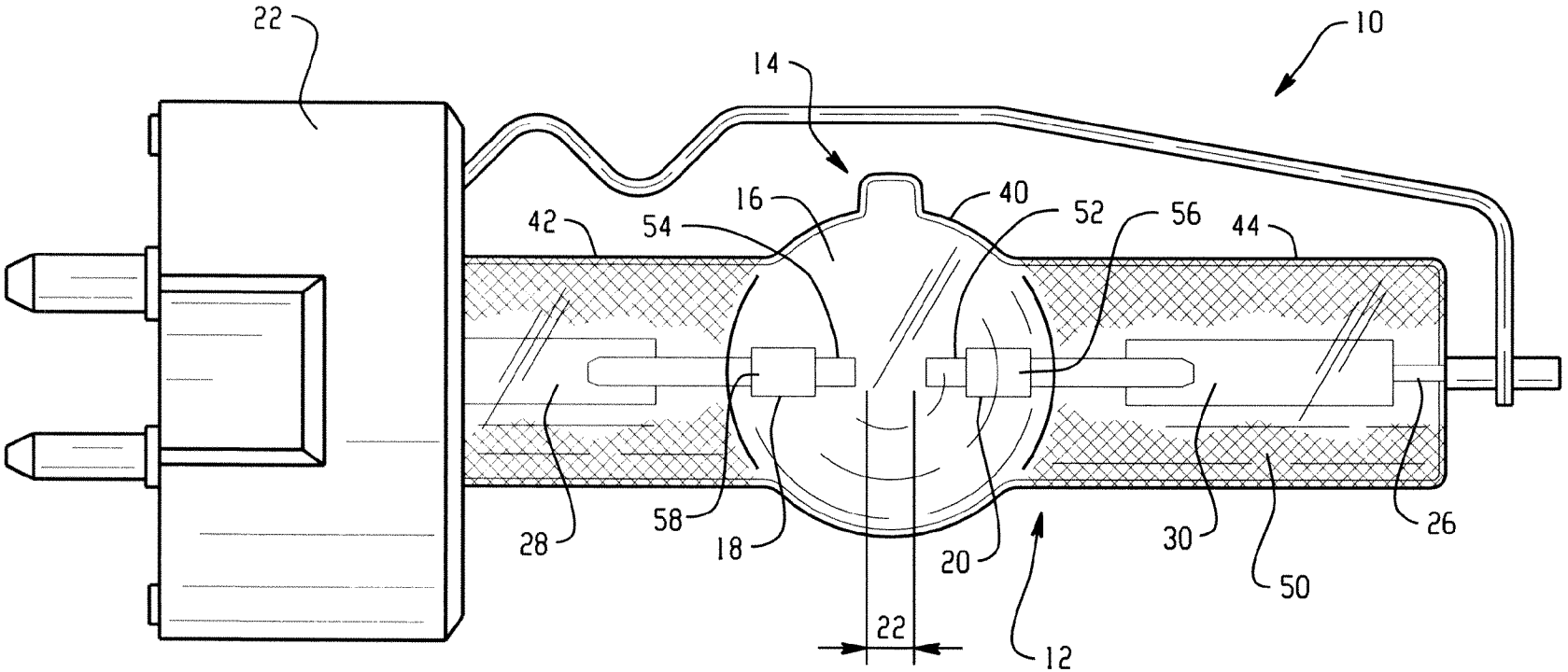
FIG. 1 is a schematic cross sectional view of a lamp assembly according to the exemplary embodiment.

With reference to FIG. 1, an exemplary electric lamp assembly 10 includes a light source or lamp 12. The lamp 12 includes a light transmissive discharge vessel or envelope 14, which is typically formed from a transparent vitreous material, such as quartz. The exemplary discharge vessel 14 is formed of a high temperature resistant, light permeable material formed as a single component. The discharge vessel 14 defines an internal chamber 16. The discharge vessel 14 may be coated with a UV or infrared reflective coating as appropriate. The exemplary lamp 12 may be a high intensity discharge (HID) lamp, which operates at wattage of at least about 1000 W, e.g., at least about 1200 W or at least 1500 W, and in one embodiment, at least about 1800 W, e.g., up to about 2500 W.

Hermetically sealed within the chamber 16 is a discharge sustaining fill, as noted above, which will be described in greater detail below. Internal electrodes 18, 20 extend coaxial with the lamp axis into the chamber 16 from opposite ends thereof and define a gap 22 of distance $arc_{GAP}$ for supporting an electrical discharge during operation of the lamp. The $arc_{GAP}$ may be, for example, from about 3 mm to about 5 cm, e.g., about 8 mm to about 1.2 cm, and in one embodiment, about 10 mm.

Figure 2:
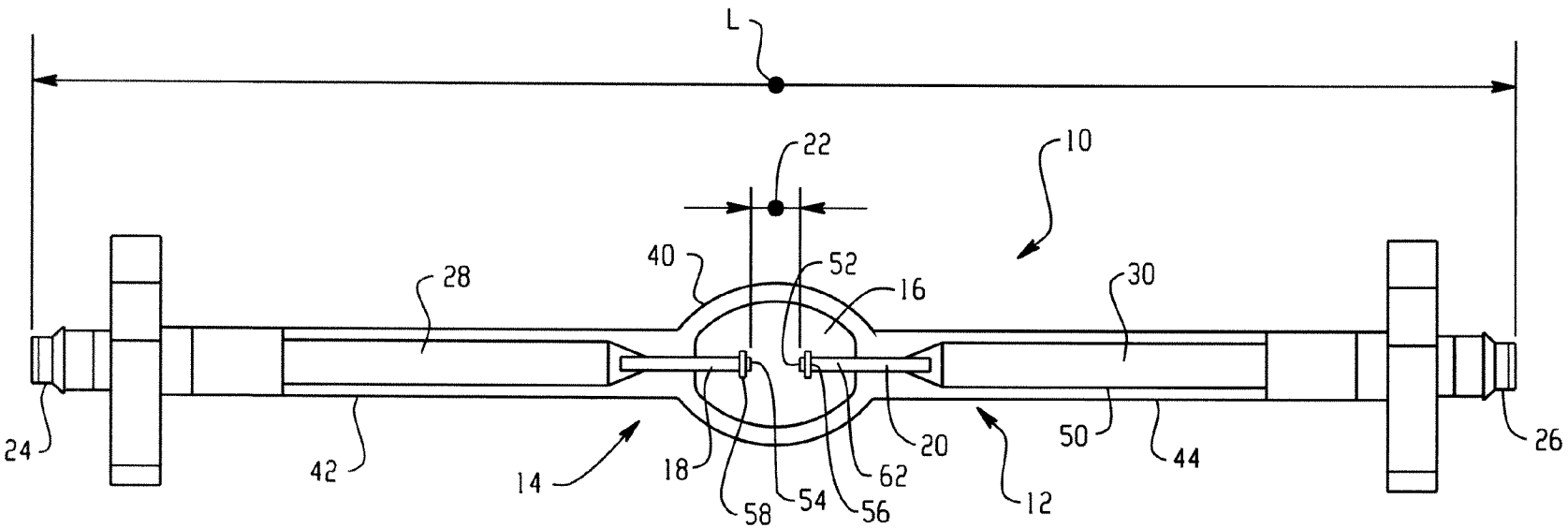
FIG. 2 is an enlarged schematic view of the lamp of FIG. 1.

With reference also to FIG. 2, the internal electrodes 18, 20 may be formed primarily from an electrically conductive material, such as tungsten. The electrode surface area may be optimized for current density. The internal electrodes 18, 20 are electrically connected with external connectors 24, 26 by foil connectors 28, 30. The illustrated external connectors 24, 26 extend outwardly to bases (not shown) at respective ends of the discharge vessel 14 for electrical connection with a source of power as shown in FIG. 2, or may be connected with a single-ended base 32, as shown in FIG. 1. Connectors 24, 26 may be in the shape of pins or tubes and may be formed primarily from an electrically conductive material, such as molybdenum or niobium or alloy thereof.

The illustrated lamp discharge vessel 14 includes a bulbous central portion 40 and opposed stem portions or legs 42, 44, which extend outwardly from the bulbous central portion along the longitudinal axis of the lamp 12. Other lamp configurations are also contemplated. For example, the lamp discharge vessel 14 may have a substantially constant cross-sectional diameter. The foil connectors 28, 30 are situated in the stem portions 42, 44. The foil connectors 28, 30 may be welded, brazed, or otherwise connected at ends thereof to the respective external connectors 24, 26 and internal electrodes 18, 20.

Figure 3:
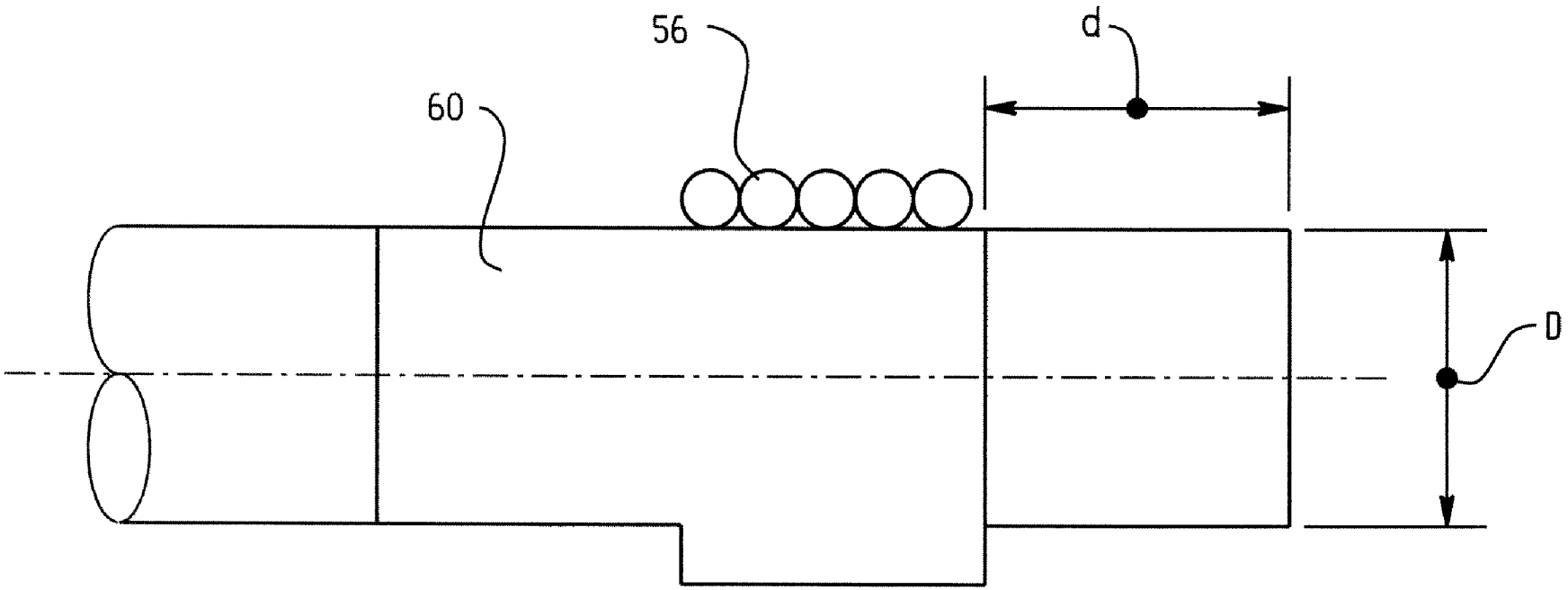
FIG. 3 is an enlarged cross sectional view of the electrode of the lamp of FIG. 2.

With reference now to FIG. 3, the inner end of each electrode 18, 20 defines an electrode tip 52, 54. An overwind coil 56, 58, spaced from the respective electrode tip by a distance d, is located at a predetermined position on the electrode 18, 20. The overwind coil 56, 58 can be a tungsten and/or a molybdenum wire having a diameter of about 0.4 mm wound around a shank 60, 62 and having about 5-15 turns, e.g., about 4 mm in axial length. Although molybdenum is less prone to cracking than other materials, it is recognized that the overwinding may be formed from any other appropriate material. The distance d may be at least 0.5 mm, e.g., 1-2 mm, and in one embodiment about 2 mm. The diameter D of the electrode may be at least about 1.25 mm and in one embodiment, less than 2 mm, e.g., about 1.4-1.9 mm. The lamp may have an overall length L of, for example, from about 10-30 cm, e.g., about 22 cm. In one embodiment, the lamp is a compact lamp having an internal volume of less than 5 $cm^3$, e.g., about 3 $cm^3$, or less.

In one embodiment, the tip to coil distance d>1 mm<2 mm. The electrode diameter is >1.5<1.8. It is such that 11>Pd>9, where Pd=I/D, where I=lamp current and D=electrode diameter.

During assembly of the lamp, the vitreous discharge vessel material is sealed, for example, by pinching the vitreous material, in the region of the foil connectors 28, 30, to form seals.

The lamp may be mounted in a fixture, such as a reflective housing. The housing may be open to the atmosphere or hermetically sealed with a lens or cover to provide a jacket for the lamp. In the exemplary embodiment, the lamp is completely without a jacket or housing.

In one embodiment, the fill satisfies the following molar ratio:

$$0.3 \le \frac{X}{Y} \le 3.5 \qquad \text{Eqn. 1}$$

where X=Dy+Ho+Z+Tm+Cs,

Dy=moles of dysprosium halide in the fill,

Ho=moles of holmium in the fill,

Z=total moles of thallium halides in the fill,

Tm=moles of thulium

Cs=moles of cesium halide in the fill,

Y=moles of mercury halide in the fill.

In one embodiment, Y is less than X. This may be the case, for example, where Eqn. 1 is satisfied and a relatively low concentration of mercury halide is present.

$$0.5 \le \frac{X}{Y} \le 2.4 \qquad \text{Eqn. 2}$$

In one embodiment, the ratio X/Y is at least 1, and in some embodiments, at least about 1.2. In other embodiments X/Y is at least 1.8. In other embodiments X/Y is less than 2.1.

In one embodiment, Z=0 or Z is neodymium halide.

In another embodiment, the weight of the dysprosium halide exceeds the weight of the thallium halide and holmium halide (e.g. Dy>Tl>Ho), or dysprosium halide exceeds the weight of the thallium halide and thulium halide (e.g. Dy>Tl>Tm), or dysprosium halide exceeds the weight of the thallium halide and cesium halide (e.g. Dy>Tl>Cs) and in one specific embodiment, the weight of thallium halide exceeds the weight of any other individual component of X.

The ratio X/Y may be tailored to lamp dimensions. By way of example, in one embodiment (Lamp 1), the electrode has a diameter of 1.52 mm, a distance d of 2 mm, an overwind coil of about 10 turns, the lamp has an arc gap of 9-11 mm, and the ionizable gas molar ratio X:Y is 1:0.5. This lamp may be operated at a voltage of 110-130V. In another embodiment (Lamp 2), the electrode has a diameter of 1.65 mm, a distance d of 2 mm, an overwind coil of about 5 turns an arc gap of 9-11 mm and the ionizable gas molar ratio X:Y is 1:0.8. The lamp may be operated at a voltage of 110-130V.

In one embodiment, a molar ratio of halides in the fill is satisfied by:

$$\frac{Dy}{W} \ge 1$$

where Dy=moles of dysprosium in the fill,

W=Cs+Ho+Tm+Tl,

Cs=moles of cesium in the fill,

Ho=moles of holmium in the fill,

Tm=moles of thulium in the fill, and

Tl=moles of thallium in the fill.

In some embodiments, $$\frac{Dy}{W} \ge 1.5 \text{ or } \ge 2.$$

In one embodiment, both mercury iodide and mercury bromide are present. A molar ratio of mercury iodide to mercury bromide in the fill may be 1.2 to 1.5.

The halides in the fill may be bromides, iodides, or a combination thereof. The halide compounds usually will represent stoichiometric relationships.

The halides in the fill may include at least one rare earth halide selected from dysprosium, holmium, and thulium, and in one embodiment, the fill at least three of these rare earth halides. In one embodiment, dysprosium, holmium and thulium are all present in the fill. Dysprosium, holmium, and thulium halide-containing lamps are able to meet Color Correction Temperature (CCT) and Color Rendering Index (CRI) targets desirable for entertainment lighting applications with ease. The rare earth halide(s) may contribute a total of at least 20 mol % of the halides in the fill, and in one embodiment, at least 25 mol %, and can be up to about 60 mol %, e.g. less than about 40 mol %.

The halide component may include cesium halide. The cesium halide may be at a molar concentration of at least about 6% and in one embodiment, less than about 13% of the total halides in the fill. In some embodiments, cesium halides make up at least about 10 mol % of the halides in the fill.

The halide component may include a gadolinium halide at a total molar concentration of at least about 2 mol % and in one embodiment, less than about 13 mol % of the total halides in the fill. In some embodiments, the total of gadolinium halide is less than about 0.1 mol % and can be 0.

The halide component may include one or more of neodymium and thallium halides at a total molar concentration of at least about 10 mol %, and in one embodiment, less than about 13 mol % of the total halides in the fill. In some embodiments, the total of indium and thallium halides is less than about 0.1 mol %, and can be 0.

The halide component includes mercury halide. The mercury halide may be at least mercury bromide and mercury iodide. The mercury halide may be at a molar concentration of at least about 25 mol %, and in one embodiment, less than about 65 mol % of the total halides in the fill. In some embodiments, mercury halides make up at least about 60 mol % of the halides in the fill.

Expressed as molar percents (number of moles of halide divided by the total moles of halide in the fill), the fill may comprise:

TABLE 2

| Halide | Mol % of halides in the fill |
|---|---|
| mercury | 5-70%, e.g., at least 50%, e.g., less than 60% |
| cesium | 5-15%, e.g., at least 6%, e.g., less than 13% |
| rare earth | 20-60%, e.g., at least 25%, e.g., less than 40% |
| neodymium and/or thallium | 0-22%, e.g., when present at least 10% |

In a first exemplary embodiment, the fill includes halides of dysprosium, holmium, thulium, cesium and thallium. Other halides (not including mercury halide) may account for a total of less than 12 mol % of the fill, e.g., less than about 5%, and in one embodiment, less than about 1%, and can be as low as about 0%. In this embodiment, the molar ratio of dysprosium halide to cesium halide may be at least 3:1. The molar ratio of dysprosium halide to thallium halide may be from about 1.5:1 to about 3.5:1, e.g., about 2.5:1. The molar ratio of Dy:Cs:Ho:Tm:Tl may be about 3:1:0.2:0.1:2, i.e., for every three moles of Dy, there are about 1 mole of Cs, 0.2 mol of Ho, 0.1 mol of Tm and 2 moles of Tl. For example, a fill comprising dysprosium, cesium, holmium, thulium and thallium at concentrations of about 1.02, 0.31, 0.06, 0.04, and 0.4 μmol/cm$^3$ (e.g., in which each of these concentrations may vary by no more than ±20%, e.g. less than 15%, e.g., less than 10%, or less than 5%) respectively, may be provided.

Unjacketed lamps formed according to this embodiment may have a CCT of at least 5200K, a color rendering of at least 90, and an efficacy of at least 85 lm/W.

In a second exemplary embodiment, the fill includes halides of dysprosium, holmium, thulium, cesium and thallium. Other halides (not including mercury halide) may account for a total of less than 12 mol % of the fill, e.g., less than about 5%, and in one embodiment, less than about 1%, and can be as low as about 0%. In this embodiment, the molar ratio of dysprosium halide to cesium halide may be at least 3:1. The molar ratio of dysprosium halide to thallium halide may be from about 0.8:1 to about 2:1, e.g., about 1.26:1. The molar ratio of Dy:Cs:Ho:Tm:Tl may be about 3:1:0.2:0.1:2.5, i.e., for every three moles of Dy, there are about 1 mole of Cs, 0.2 mol of Ho, 0.1 mol of Tm and 2.5 mol of Tl. For example, a fill comprising dysprosium, cesium, holmium, thulium and thallium at concentrations of about 1.02, 0.31, 0.06, 0.04, and 0.81 μmol/cm$^3$ (e.g., in which each of these concentrations may vary by no more than ±20%, e.g. less than 15%, e.g., less than 10%, or less than 5%) respectively, may be provided.

In another exemplary embodiment, the fill includes halides of dysprosium, holmium, thulium, and cesium. Other halides (not including mercury halide) may account for a total of less than 12 mol % of the fill, e.g., less than about 5%, and in one embodiment, less than about 1%, and can be as low as about 0%. In this embodiment, the molar ratio of dysprosium halide to cesium halide may be at least 3:1. The molar ratio of Dy:Cs:Ho:Tm may be about 3:1:0.2:0.13, i.e., for every three moles of Dy, there are about 1 mole of Cs, 0.2 mol of Ho, and 0.13 mol of Tm. For example, a fill comprising dysprosium, cesium, holmium, and thulium at concentrations of about 1.02, 0.31, 0.06, and 0.04 μmol/cm$^3$ (e.g., in which each of these concentrations may vary by no more than ±20%, e.g. less than 15%, e.g., less than 10%, or less than 5%) respectively, may be provided.

An exemplary fill for the lamp is shown in Table 3:

TABLE 3

| Halide | Fill concentration in (μmol/cm$^3$) | Fill concentration in (μmol/cm$^3$) | mol % of halide in fill |
|---|---|---|---|
| mercury (iodide) | 0.5-1.8 | 0.5-1.5, e.g. ≧ 0.8 | 8-30 |
| mercury (bromide) | 1.4-7.3 | 1.7-6.1, e.g. ≧ 2.0 | 20-65 |
| cesium | 0.25-2.3 | 0.3-1.9, e.g. ≧ 0.5 | 4.4-13 |
| dysprosium | 0.7-2.3 | 0.9-1.9, e.g. ≧ 1.1 | 14.5-50 |
| holmium | 0.02-2.3 | 0.03-1.9, e.g. ≧ 0.05 | 0.8-3.0 |
| thulium | 0.02-1.8 | 0.03-1.6, e.g. ≧ 0.04 | 0.56-1.9 |
| indium and thallium | 0.50-2.0 | 0.45-1.8, e.g. ≧ 0.7 | 0.0-25.6 |

Another exemplary fill for the lamp which includes no thallium or indium halide in the fill is shown in Table 4:

TABLE 4

| Halide | Fill concentration in (μmol/cm$^3$) | Fill concentration in (μmol/cm$^3$) | mol % of halides in fill |
|---|---|---|---|
| mercury (iodide) | 0.5-1.8 | 0.5-1.5, e.g. ≧ 0.8 | 8.0 |
| mercury (bromide) | 1.4-7.3 | 1.7-6.1, e.g. ≧ 2.0 | 20 |
| cesium | 0.25-2.3 | 0.3-1.9, e.g. ≧ 0.5 | 4.4 |
| dysprosium | 0.7-2.3 | 0.9-1.9, e.g. ≧ 1.1 | 14.5 |
| holmium | 0.02-2.3 | 0.03-1.9, e.g. ≧ 0.05 | 0.8 |
| thulium | 0.02-1.8 | 0.03-1.6, e.g. ≧ 0.04 | 0.56 |

The inert gas may be added to provide the lamp with a cold fill pressure of 300-500 torr.

In another exemplary embodiment, the fill consists essentially of mercury dysprosium, holmium, thulium, cesium and thallium halides. By this it is meant that other halides may account for a total of less than 5 mol % of the fill, e.g., less than about 2 mol %, and in one embodiment, less than about 1 mol %, and can be as low as about 0%. In this embodiment, the molar ratio of dysprosium halide to cesium halide may be at least 3:1. The molar ratio of dysprosium halide to thallium halide may be from about 1.25:1 to about 2.6:1, e.g., about 2:1. The molar ratio of Dy:Cs:Ho:Tm:Tl may be about 3:1:0.2:0.1:3, i.e., for every three moles of Dy, there are about 1 mole of Cs, 0.2 mol of Ho, 0.1 mol of Tm and 1.3 moles of Tl. For example, a fill consisting essentially of dysprosium, cesium, holmium, thulium and thallium at concentrations of about 1.02, 0.31, 0.06, 0.04, and 0.4 μmol/cm$^3$ (e.g., in which each of these concentrations may vary by no more than ±20%, e.g. less than 15%, e.g., less than 10%, or less than 5%) respectively, may be provided. In some embodiments, the fill is free of all rare earth halides, other than Dy, Ho, and Tm. By this it is meant that rare earth halides other than Dy, Ho, and Tm are present in the fill at a total mol % of <0.3, e.g., <0.1, or <0.01, and in some embodiments, as close to a mole % of 0% as can be practically achieved.

Correlated Color Temperature (CCT) is defined as the absolute temperature, expressed in degrees Kelvin (K), of a black body radiator when the chromaticity (color) of the black body radiator most closely matches that of the light source. CCT may be estimated from the position of the chromatic coordinates (u, v) in the Commission Internationale de l'Eclairage (CIE) 1960 color space. As the temperature rises, the color appearance shifts from yellow to blue. From this standpoint, the CCT rating is an indication of how "warm" or "cool" the light source is. The higher the number, the cooler the lamp. The lower the number, the warmer the lamp. The CCT can be at least 5000K or 5400K in some embodiments and can be up to about 6000K, e.g., about 5600K.

The efficacy of a lamp is the luminous flux divided by the total radiant flux, expressed in units of lumens per Watt. It is a measure of how much of the energy supplied to the lamp is converted to visible light. The efficacy can be at least 80 lm/W, or at least 85 lm/W, and in some embodiments and can be up to about 90 lm/W, or higher.

The color rendering index (CRI) is an indication of a lamp's ability to show individual colors relative to a standard. This value is derived from a comparison of the lamp's spectral distribution compared to a standard (typically a black body) at the same color temperature. There are fourteen special color rendering indices (Ri where i=1-14) which define the color rendering of the light source when used to illuminate standard color tiles. The general color rendering index (Ra) is the average of the first eight special color rendering indices (which correspond to non-saturated colors) expressed on a scale of 0-100. Unless otherwise indicated, color rendering is expressed herein in terms of the Ra. The color rendering index can be at least 85, in some embodiments at least 90, and in specific embodiments, about 92 or greater, when Tl is present, slightly lower in the absence of Tl.

The exemplary lamps have a high CCT and Ra. Combined with a small arc gap and a transparent discharge vessel, the fill provides improved performance of the system by providing better color rendering, higher brightness, better optical control, and more uniform beam than in conventional lamps. Higher CCT, at least as high as 5000K is perceived as whiter and brighter, than lower CCT lamps of comparable power or lumen output. This makes this lamp desirable for entertainment lighting such as moving head lights.

All of these ranges may be simultaneously satisfied in the present lamp design. Unexpectedly, this can be achieved without negatively impacting lamp reliability or lumen maintenance. Thus, for example, the exemplary lamp may have a lumen maintenance of approximately 95% or better at 1500 hours, e.g. at a wall temperature which is no greater than 6000K.

The fill provides the desired CCT and CRI properties without the need for a jacket. This enables the lamp to have a high efficacy. The lamp is suited to applications such as theater and concert illumination (with or without a reflector) and in other applications where visible radiation is used for establishing mood or atmosphere or for projection of images whether static or dynamic. The high color temperature achieved by this invention results in a higher perceived brightness by the user than would otherwise be experienced for a product with identical performance save for a lower color temperature.

The exemplary lamp may have a Correlated Color Temperature (CCT) of at least about 5500K, a color rendering index of at least about 92, and a lumen output at about 1500 hours of at least about 85 LPW in a compact discharge vessel, free of an outer jacket, where the outer side of the discharge vessel is in contact with free (atmospheric air).

$P_{ARC}$, the arc wall loading, is the lamp power per unit area of the interior of the discharge vessel, as measured between the electrodes, i.e., $$P_{\mathrm{ARC}} = \frac{P_{LAMP}}{2\pi r_{LAMP}\mathrm{arc}_{GAP}}$$

where $P_{LAMP}$ is the lamp power in Watts, $r_{LAMP}$ is the radius of the discharge vessel and $\mathrm{arc}_{GAP}$ is the distance between the electrodes. If $r_{LAMP}$ and $\mathrm{arc}_{GAP}$ are expressed in mm, $P_{ARC}$ is expressed in W/mm$^2$. $P_{ARC}$ may be, for example, at least 1200 W/mm$^2$, e.g., about 1300 W/mm$^2$ or higher. The arc wall loading may be at least 1800 W/mm$^2$ and in some embodiments, may be up to about 3000 W/mm$^2$, or higher. In one specific embodiment, $P_{ARC}$ is less than about 2400. For arc wall loading calculations, even though the discharge vessel may be curved between the electrodes, it may be approximated as a cylinder (having an r value corresponding to an average r value) for arc wall loading calculations.

Unjacketed lamps formed according to this embodiment may have a CCT of at least 5500K, a CRI of at least 92, and an efficacy of at least 85 lm/W, when Tl is present, or at least about 80 lm/W in the absence of Tl.

In operation, a voltage is applied between the electrodes, for example by connecting the electrodes with a source of power via suitable ballast, such as an electronic ballast. A discharge is created between the electrodes and visible light is emitted from the lamp. Stable operation occurs shortly thereafter, at which time, stable measurements of CRI, CCT, and efficacy can be made.

Without intending to limit the scope of the invention, the following examples demonstrate the properties of fill compositions formulated according to the exemplary embodiments.

EXAMPLES

Example 1

Lamps were formed having a discharge vessel configured as shown in FIG. 1 with an arc gap of 10 mm. The arc tube had an interior volume of 3 cm$^3$. The lamps were filled with a fill comprising a halide component as indicated in Examples A to G in Tables 5 and 6, back filled with Argon/Krypton to a pressure of 200-500 torr, and pinch sealed. None of the lamps had outer jackets. Tables 4 and 5 show CCT, Ra, and luminous efficacy values, which were obtained using standard photometry with an integrating sphere while operating the lamp at rated power. Lamp power ranged from 1000-2500 W. The lamps were allowed to warm up for at least about 15 minutes before measuring. Some of the results are averages for two or three lamps.

TABLE 5

| (Halide) | Example A | | Example B | | Example C | | Example D | |
|---|---|---|---|---|---|---|---|---|
| (Iodide) | μmol | mol % | μmol | mol % | μmol | mol % | μmol | mol % |
| Dy | 1.02 | 21.1 | 1.02 | 18.1 | 1.02 | 23.0 | 1.02 | 42.0 |
| Cs | 0.31 | 6.4 | 0.31 | 5.5 | 0.31 | 7.0 | 0.31 | 12.8 |
| Ho | 0.06 | 1.2 | 0.06 | 1.1 | 0.06 | 1.4 | 0.06 | 2.5 |
| Tm | 0.04 | 0.8 | 0.04 | 0.7 | 0.04 | 0.9 | 0.04 | 1.6 |
| $HgBr_2$ | 2.4 | 49.7 | 2.4 | 42.6 | 2.4 | 54.2 | 0.0 | 0.0 |
| $HgI_2$ | 0.6 | 12.4 | 0.6 | 10.7 | 0.6 | 13.5 | 0.6 | 24.6 |
| TlBr | 0.4 | 8.4 | 1.2 | 21.3 | 0.0 | 0.0 | 0.4 | 16.5 |
| Total mol halides | 4.83 | 100 | 5.63 | 100 | 4.43 | 100 | 2.43 | 100 |
| CRI, Ra | 96.4 | | 91.1 | | 88.3 | | 95.6 | |
| CCT, K | 5572 | | 5678 | | 5481 | | 5087 | |
| Efficacy, Lm/W | 85.7 | | 87.2 | | 90.0 | | 87.3 | |

TABLE 6

| (Halide) | Example E | | Example F | | Example G | |
|---|---|---|---|---|---|---|
| (Iodide) | μmol | mol % | μmol | mol % | μmol | mol % |
| Dy | 1.02 | 23.8 | 1.02 | 27.1 | 1.02 | 18.1 |
| Cs | 0.31 | 7.2 | 0.31 | 8.2 | 0.31 | 5.5 |
| Ho | 0.06 | 1.4 | 0.06 | 1.6 | 0.06 | 1.1 |
| Tm | 0.04 | 0.9 | 0.04 | 1.1 | 0.04 | 0.7 |
| $HgBr_2$ | 1.85 | 43.2 | 0.93 | 24.7 | 2.4 | 42.6 |
| $HgI_2$ | 0.6 | 14.1 | 0.6 | 15.8 | 0.6 | 10.7 |
| TlBr | 0.4 | 9.4 | 0.81 | 21.5 | 1.20 | 21.3 |
| Total Mol halides | 4.28 | 100 | 3.78 | 100 | 5.63 | 100 |
| CRI, Ra | 97.5 | | 99.2 | | 84.7 | |
| CCT, K | 5819 | | 5493 | | 5572 | |
| Efficacy, Lm/W | 76.3 | | 82.7 | | 73.6 | |

Figure 4:
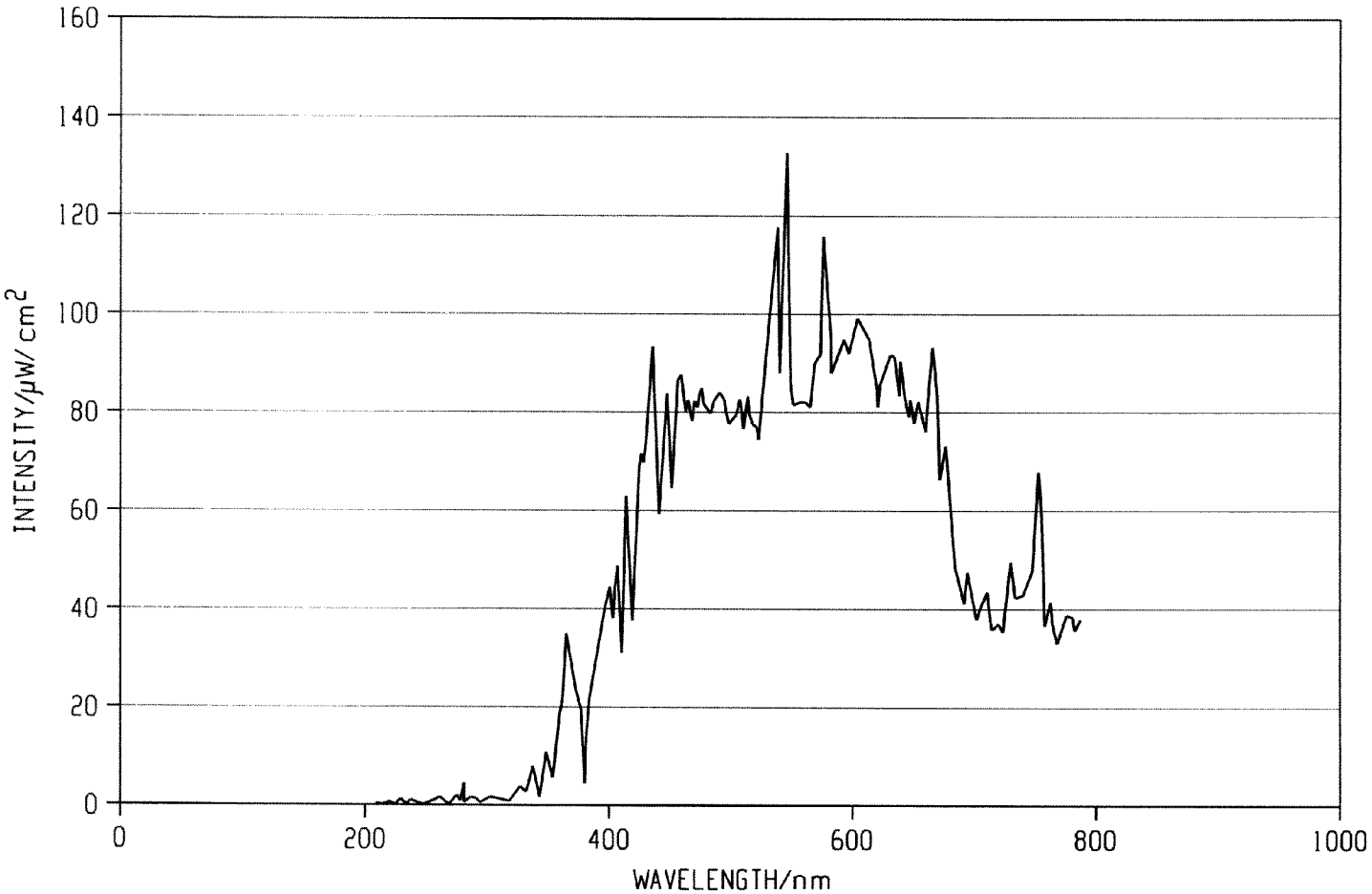
FIG. 4 is a spectrum of a lamp in accordance with the exemplary embodiment in the wavelength range of 200-800 nm.

FIG. 4 shows an example spectrum in the wavelength range of 200-800 nm. The fill used was as for Example D in a lamp as described in Example 1. In this embodiment the electrode diameter D is about 1.52 mm, the tip to coil distance d is about 2 mm, the $arc_{GAP}$ is about 9 to 11 mm with a voltage of about 110-130 V. This spectrum demonstrates that the lamp output is predominantly within the visible range (400-700 nm) and over this range is relatively uniform in its output, indicative of white light.

Figure 5:
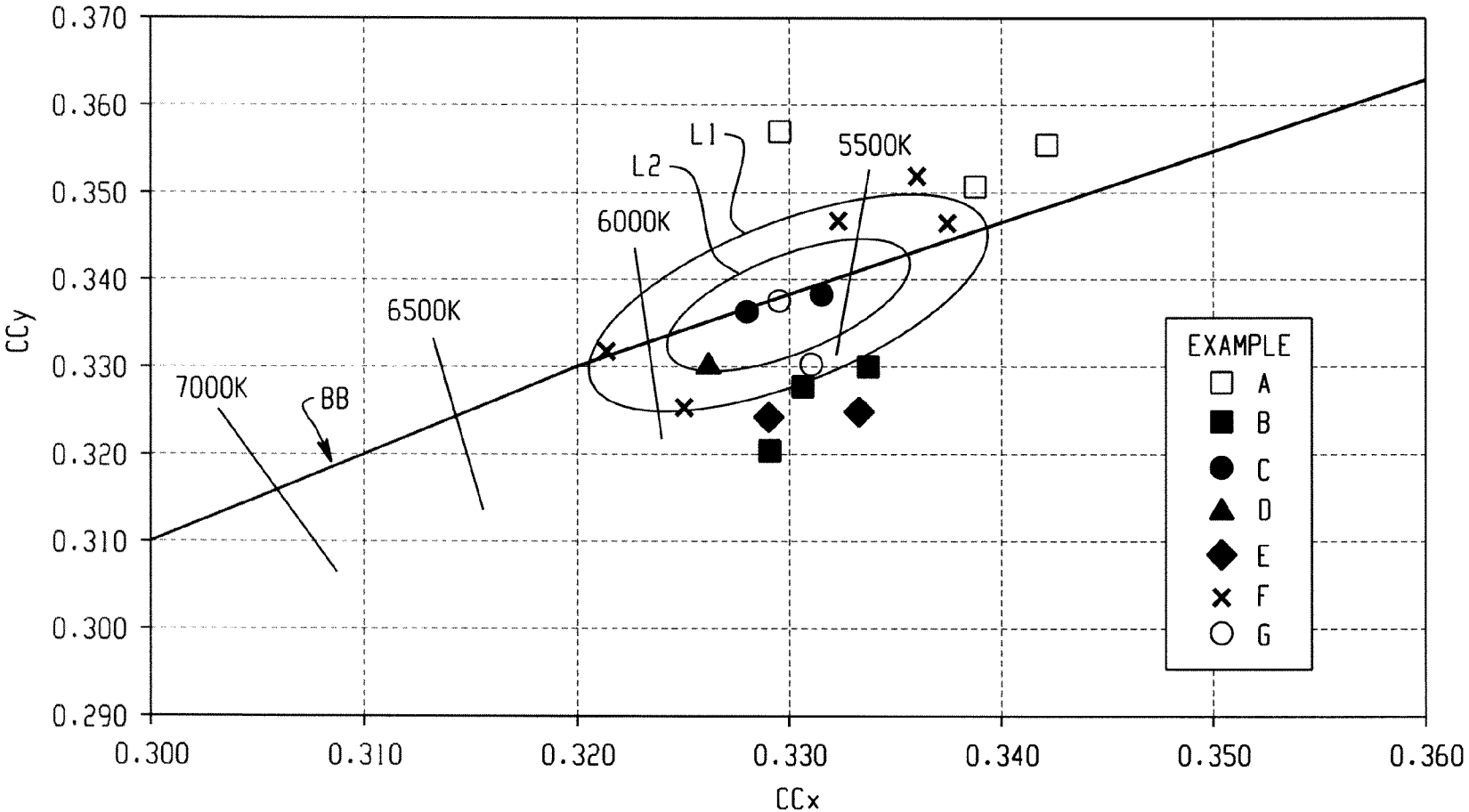
FIG. 5 illustrates a plot of ccx vs ccy for the exemplary lamps showing the locus of lamps in Examples A-G.

FIG. 5 shows ccx vs ccy data for exemplary lamps formed in accordance with the exemplary embodiment. The black body curve is shown as BB. Those lamps falling within the locus L1 give acceptable white color, with those falling in locus L2 are closer to the black body curve, giving more accurate white light. Lamps of examples A-G are shown in the key The invention has been described with reference to the preferred embodiments. Obviously, modifications and alterations will occur to others upon reading and understanding the preceding detailed description. It is intended that the invention be construed as including all such modifications and alterations.

What is claimed is:

1. A high intensity discharge lamp which operates at over 1000 watts comprising:

a discharge vessel;

electrodes extending into the discharge vessel, and an ionizable fill sealed within the vessel, the fill comprising:

an inert gas, and a halide component comprising:

a mercury halide wherein the mercury halide comprises both mercury iodide and mercury bromide, a cesium halide, at least one of a thallium halide and a neodymium halide, and rare earth halides including a dysprosium halide, a holmium halide, and a thulium halide, wherein the fill is free of all rare earth halides other than halides of dysprosium, holmium, neodymium, and thulium, and wherein a molar ratio of halides in the fill is satisfied by:

$$0.3 \leqq X/Y \leqq 3.5$$

where X=Dy+Ho+Z+Tm+Cs, and

Dy=moles of dysprosium halide in the fill,

Ho=moles of holmium halide in the fill,

Z=total moles of thallium halide in the fill,

Tm=moles of thulium halide in the fill,

Cs=moles of cesium halide in the fill, and

Y=moles of mercury halide in the fill.

2. A high intensity discharge lamp which operates at over 1,000 watts, comprising:

a discharge vessel;

electrodes extending into the discharge vessel; and an ionizable fill sealed within the vessel, the fill consisting essentially of, an inert gas, and a halide component, the halide component consisting essentially of:

25-70 mol % of mercury halide, 5-15 mol % of cesium halide, a total of 0-22 mol % of at least one of thallium halide and neodymium halide, and, a dysprosium halide, a holmium halide, and a thulium halide at a total of 20-60 mol %.

3. The lamp of claim 1, wherein X/Y≧1.

4. The lamp of claim 1, wherein X/Y≦2.2.

5. The lamp of claim 1, wherein thallium halide=0.

6. The lamp of claim 1, wherein a molar ratio of halides in the fill is satisfied by:

$$\frac{Dy}{W} \geq 1$$

where Dy=moles of dysprosium in the fill, and
W=Cs+Ho+Tm+Tl,
Cs=moles of cesium halide in the fill,
Ho=moles of holmium halide in the fill,
Tm=moles of thulium halide in the fill, and
Tl=moles of thallium halide in the fill.

7. The lamp of claim 6, wherein Dy/W≧1.2.

8. The lamp of claim 6, wherein Dy/W≧2.0.

9. The lamp of claim 1, wherein the electrode comprises a coil spaced from a tip of the electrode, wherein the coil is wound on one end of the electrode from about five turns to about ten turns, and wherein the electrode includes a shank having a diameter of about 1.4 mm to about 1.7 mm.

10. The lamp of claim 9, wherein the coil comprises at least one of tungsten and molybdenum.

11. The lamp of claim 1, wherein the mercury iodide and mercury bromide are present in the fill at a molar ratio of from 1:2 to 1:5.

12. The lamp of claim 1, wherein the mercury iodide is present in the fill at a concentration of from 0.5 to 1.8 micromoles/$cm^3$.

13. The lamp of claim 1, wherein the mercury bromide is present in the fill at a concentration of from 1.4 to 7.3 micromoles/$cm^3$.

14. The lamp of claim 1, wherein the fill comprises:
0.25 to 2.3 micromoles/$cm^3$ of cesium halide,
0.7 to 2.3 micromoles/$cm^3$ of dysprosium halide,
0.02 to 2.3 micromoles/$cm^3$ of holmium halide,
0.02 to 1.8 micromoles/$cm^3$ of thulium halide, and,
a total of 0.5 to 2.0 micromoles/$cm^3$ of at least one of neodymium halide and thallium halide.

15. The lamp of claim 1, wherein the fill comprises:
25-70 mol % of mercury halide,
5-15 mol % of cesium halide,
20-60 mol % of rare earth halide, and
0-22 mol % of thallium halide.

16. The lamp of claim 1, wherein the lamp is unjacketed.

17. A method of forming a lamp which operates at over 1000 watts, comprising:

providing a discharge vessel;

sealing an ionizable fill within the vessel, the fill comprising:
an inert gas,
a halide component comprising:
a mercury halide wherein the mercury halide comprises both mercury iodide and mercury bromide;
a cesium halide;
at least one of a neodymium halide and a thallium halide; and
a rare earth halide including a dysprosium halide, a holmium halide, and a thulium halide, wherein the fill is free of all rare earth halides other than halides of dysprosium, holmium, neodymium, and thulium, wherein a molar ratio of halides in the fill is satisfied by:

$$0.3 \leqq X/Y \leqq 3.5$$

wherein X=Dy+Ho+Z+Tm+Cs,
Dy=moles of dysprosium halide in the fill,
Ho=moles of holmium halide in the fill,
Z=total moles of thallium halide in the fill,
Tm=moles of thulium halide in the fill,
Cs=moles of cesium halide in the fill, and
wherein Y=moles of mercury halide in the fill; and positioning electrodes within the discharge vessel which energize the fill when an electric current is applied thereto.

18. A method of operating a high intensity discharge lamp comprising:

supplying an electric current to the lamp to generate a discharge in the lamp vessel, wherein in operation, the lamp operates at:
a correlated color temperature (CCT) of at least 5300K;
a color rendering index (CRI) of at least 92; and
a lumen output at about 1500 hours of at least 85 LPW; and wherein the discharge is provided by a lamp fill comprising:
an inert gas, and
a halide component comprising:
a mercury halide wherein the mercury halide comprises both mercury iodide and mercury bromide,
a cesium halide,
at east one of a thallium halide and a neodymium halide, and
rare earth halides including a dysprosium halide, a holmium halide, and a thulium halide, wherein the fill is free of all rare earth halides other than halides of dysprosium, holmium, neodymium, and thulium, and
wherein a molar ratio of halides in the fill is satisfied by:

$$0.3 \leqq X/Y \leqq 3.5$$

where X=Dy+Ho+Z+Tm+Cs, and
Dy=moles of dysprosium halide in the fill,
Ho=moles of holmium halide in the fill,
Z=total moles of thallium halide in the fill,
Tm=moles of thulium halide in the fill,
Cs=moles of cesium halide in the fill, and
Y=moles of mercury halide in the fill.

19. The lamp of claim 2, wherein a molar ratio of halides in the fill is satisfied by:

$$0.3 \leqq X/Y \leqq 3.5$$

where X=Dy+Ho+Z+Tm+Cs,
Dy=moles of dysprosium halide in the fill,
Ho=moles of holmium halide in the fill,
Z=total moles of thallium halides in the fill,
Tm=moles of thulium halide,
Cs=moles of cesium halide in the fill, and
Y=moles of mercury halide in the fill.

20. The high intensity discharge lamp of claim 19, wherein halides other than mercury, cesium, thallium, dysprosium halides, holmium halides, and thulium halides, account for less than 1 mol % of the halide component.

21. The lamp of claim 1, wherein the mercury iodide is present in the fill at a concentration of from 0.5 to 1.5 micromoles/$cm^3$.

22. The lamp of claim 1, wherein the mercury bromide is present in the fill at a concentration of from 1.7 to 6.1 micromoles/$cm^3$.

23. The lamp of claim 1, wherein the fill comprises:
0.3 to 1.9 micromoles/$cm^3$ of cesium halide,
0.9 to 1.9 micromoles/$cm^3$ of dysprosium halide,
0.03 to 1.9 micromoles/$cm^3$ of holmium halide,
0.03 to 1.6 micromoles/$cm^3$ of thulium halide, and
a total of 0.45 to 1.8 micromoles/$cm^3$ of at least one of neodymium halide and thallium halide.

* * * * *